US005296098A

United States Patent [19]

Fjällström

[11] Patent Number: 5,296,098

[45] Date of Patent: Mar. 22, 1994

[54] METHOD AND DEVICE FOR SEPARATING A FIBRE SUSPENSION

[75] Inventor: Roland Fjällström, Lawrenceville, Ga.

[73] Assignee: Celleco Hedemora AB, Stockholm, Sweden

[21] Appl. No.: 778,082

[22] PCT Filed: Mar. 19, 1991

[86] PCT No.: PCT/SE91/00208

§ 371 Date: Dec. 10, 1991

§ 102(e) Date: Dec. 10, 1991

[87] PCT Pub. No.: WO91/15629

PCT Pub. Date: Oct. 17, 1991

[30] Foreign Application Priority Data

Apr. 11, 1990 [SE] Sweden ..... 9001322-8

[51] Int. Cl.[5] ..... B07B 1/18

[52] U.S. Cl. ..... 162/55; 210/402; 210/334; 209/250; 209/273

[58] Field of Search ..... 162/55, 56, 60, 57, 162/251; 210/331, 332, 327, 402, 334, 396, 391; 68/158; 209/273, 271, 386, 250

[56] References Cited

U.S. PATENT DOCUMENTS

| | | | |
|---|---|---|---|
| 3,002,621 | 10/1961 | Mathewson | 209/250 |
| 3,521,751 | 7/1970 | Holthius | 210/391 |
| 3,591,009 | 7/1971 | Luthi | 210/331 |
| 3,633,743 | 1/1972 | Gooding | 269/250 |
| 3,713,540 | 1/1973 | Davidson et al. | 210/391 |
| 3,724,660 | 4/1973 | Eriksson et al. | 209/250 |
| 3,789,978 | 2/1974 | Janson | 209/250 |
| 3,935,109 | 1/1976 | Rundquist et al. | 209/273 |
| 4,056,226 | 11/1977 | Hodgson | 239/17 |
| 4,138,338 | 2/1979 | Velinsky | 210/327 |
| 4,153,543 | 5/1979 | Janson | 209/273 |
| 4,275,836 | 6/1981 | Egger | 239/9 |
| 4,769,986 | 9/1988 | Kokkonen et al. | 162/60 |
| 4,952,314 | 8/1990 | Henricson | 162/60 |

FOREIGN PATENT DOCUMENTS

| | | |
|---|---|---|
| 187797 | 2/1964 | Sweden . |
| 462597 | 7/1990 | Sweden . |

*Primary Examiner*—W. Gary Jones
*Assistant Examiner*—Brenda Lamb
*Attorney, Agent, or Firm*—Davis Hoxie Faithfull & Hapgood

[57] ABSTRACT

A fibre suspension is separated by a filter device having a hollow filter body (1) with a wall (2) of filter material, and a container (3). The entire fibre suspension to be separated is sprayed in the form of at least one liquid jet onto said wall (2) to force a fine fraction of the suspension containing most of said undesired particles through said wall of filter material into the hollow filter body, thereby leaving a created coarse fraction of the fibre suspension mainly containing fibres in the container outside the filter body. Relative displacement between the liquid jet and the filter material is provided. Said created coarse fraction is dewatered through the wall of filter material, and said dewatered coarse fraction is discharged from the container.

9 Claims, 2 Drawing Sheets

METHOD AND DEVICE FOR SEPARATING A FIBRE SUSPENSION

FIELD OF THE INVENTION

The present invention relates to a method of separating a fibre suspension containing undesirable, relatively small particles by a filter device, which comprises a hollow filter body with a wall of filter material, and a container in which the filter body is situated. The invention also relates to a device for separating a fibre suspension.

BACKGROUND OF THE INVENTION

In known filter devices of this kind the fibre suspension to be separated is supplied to the container, such that the filter body is at least partly immersed in the suspension. The hydrostatic pressure in the fibre suspension in the container forces a fine fraction of the fibre suspension through the part of the wall of filter material of the filter body which is immersed in the fibre suspension, so that fibres are deposited and form a layer of fibres on the filter material. The formed layer of fibres constitutes in itself a filter medium, which is substantially tighter than the filter material of the filter body and which merely allows water from the fibre suspension in the container to pass through.

A filter device for thickening fibre suspensions is known from U.S. Pat. No. 4,138,338, which discloses a disc filter with an inlet tank for a fibre suspension to be thickened. From the inlet tank fibre suspension flows directly into a container, in which the discs are immersed in fibre suspension. To increase the dewatering capacity of the disc filter a number of spray members is arranged to spray liquid, for instance a quantity of the fibre suspension to be thickened, onto the disc walls of filter material which are immersed in the fibre suspension in the container, so that creation of tight fibre layers on the walls is prevented.

The known filter devices, as described above, are not suited for the separation of undesired relatively small particles from fibre suspensions, since most of such small particles would be trapped by the created tight layer of fibres deposited on the filter material or by thickened fibre suspension during the separation. Consequently, in practice such known filter devices usually have only been used for thickening of fibre suspensions, i.e. mere dewatering of the latter. Conventionally, undesired relatively small particles are therefore initially separated from the fibre suspensions by other kinds of separation devices, for instance by flotation plants. Subsequently, the fibre suspensions thus cleaned can be dewatered, for instance by known filter devices of the kind described above.

When producing paper from waste paper pulp the undesired relatively small particles are substantially composed of printing ink. They are separated from the waste paper pulp to avoid greyness of the produced paper. Hitherto, the profitability of producing paper from such a waste paper pulp has been poor. However, the authorities tend to tighten up the requirements on paper manufacturers to produce some paper from waste paper pulp, in order to provide a reduction of the paper waste and a saving of raw wood material.

SUMMARY OF THE INVENTION

The object of the present invention is to provide a new separation method, which reduces the costs for cleaning and dewatering fibre suspensions, preferably fibre suspensions created from waste paper pulp. A further object of the present invention is to provide a new device for accomplishing the new separation method.

These objects are obtained by a method of the kind initially stated, which is characterized by spraying the entire fibre suspension to be separated in the form of at least one liquid jet onto said wall of filter material to force a fine fraction of the suspension containing most of said undesired particles through said wall of filter material into the hollow filter body, thereby leaving a coarse fraction of the fibre suspension mainly containing fibres in the container outside the filter body; providing relative displacement between the liquid jet and the filter material; dewatering said coarse fraction of the fibre suspension through the wall of filter material; and discharging said dewatered coarse fraction from the container.

The advantage gained is that in one and the same filter device the fibre suspension is separated from undesired particles and dewatered, which means significant savings in costs as compared to the conventional method utilizing two separate devices for the separation of the undesired particles and the dewatering of the fibre suspension, respectively. By spraying the fibre suspension to be separated against said wall of filter material the sprayed elongated fibres of relatively large specific surface are rapidly retarded by the frictional drag between them and the surrounding medium (air or liquid), whereas undesired relatively small particles of relatively small specific surface substantially maintain their velocity, and thereby penetrate said wall of filter material. Said rapid retardation of the fibres has the advantage that the fibres do not press into and clog the screen passages of the filter material.

The invention also relates to a device for separating a fibre suspension containing undesired, relatively small particles, comprising a hollow filter body with a wall of filter material, a container, in which the filter body is situated, means for supplying fibre suspension to be separated, spray means arranged to spray fibre suspension onto the wall of filter material of the filter body, and means for providing relative displacement between the spray means and the wall of filter material. The new separation device is primarily characterized in that said supplying means is arranged to supply the fibre suspension to be separated solely by means of said spray means, said spray means being adapted to spray the fibre suspension onto the wall of the filter body to force a fine fraction of the fibre suspension containing most of said undesired relatively small particles through said wall of filter material into the hollow filter body and leave a pool of a coarse fraction of the fibre suspension mainly containing fibres in the container outside the filter body, said coarse fraction of the fibre suspension being dewatered through said wall of filter material during operation, and in that means is provided for discharging said dewatered coarse fraction from the container.

Preferably, said displacement means are adapted to displace the wall of filter material of the filter body alternately up and down through the surface of said pool of coarse fraction, said spray means being arranged to spray fibre suspension onto the part of the wall of filter material which is above said pool of coarse fraction. By this the advantage is gained that the fibre suspension can be sprayed under a low frictional drag through a medium of air, whereby a relatively larger share of the liquid content of the fibre suspension can be passed directly through the filter material as compared to spraying of the fibre suspension through said pool of coarse fraction.

Advantageously, said spray means is arranged to spray fibre suspension onto the part of the wall of filter material which is in said pool of coarse fraction. By this the relatively tight fibre layer formed is continuously removed from the filter material during operation by means of the liquid jet from the spray means, which has the advantage that the coarse fraction of fibre suspension in the container is more efficiently dewatered through the filter material, since-the filter material will be at least partly devoid of tight fibre layers during operation.

Suitably, said spray means is arranged to spray fibre suspension onto the part of the wall of filter material which moves downwards in said pool of coarse fraction during operation and which consequently has only been covered with a relatively thin layer of fibres. Said spray means is advantageously arranged to spray fibre suspension on a zone of said downwards moving part of the wall of filter material situated in the vicinity of the surface of said pool of coarse fraction. At said zone the created fibre layer is very thin and is readily dissolved by the sprayed fibre suspension.

Preferably, said displacement means are arranged to rotate the filter body around a horizontal axis for revolving displacement of the wall of filter material up and down through the surface of said pool of coarse fraction. In this way, the filter material can readily be continuously cleaned at a position of the filter body above said pool of coarse fraction.

The filter body may for instance be constituted by a horizontal rotary drum with a circumferential wall of filter material or by at least one vertical annular rotary disc with two side walls of filter material spaced from each other.

BRIEF DESCRIPTION OF THE DRAWINGS

The invention is explained more closely in the following with reference to the accompanying drawings, in which FIG. 1 schematically shows a drum filter according to an embodiment of the device according to the invention.

DETAILED DESCRIPTION OF THE INVENTION

Figure 1:
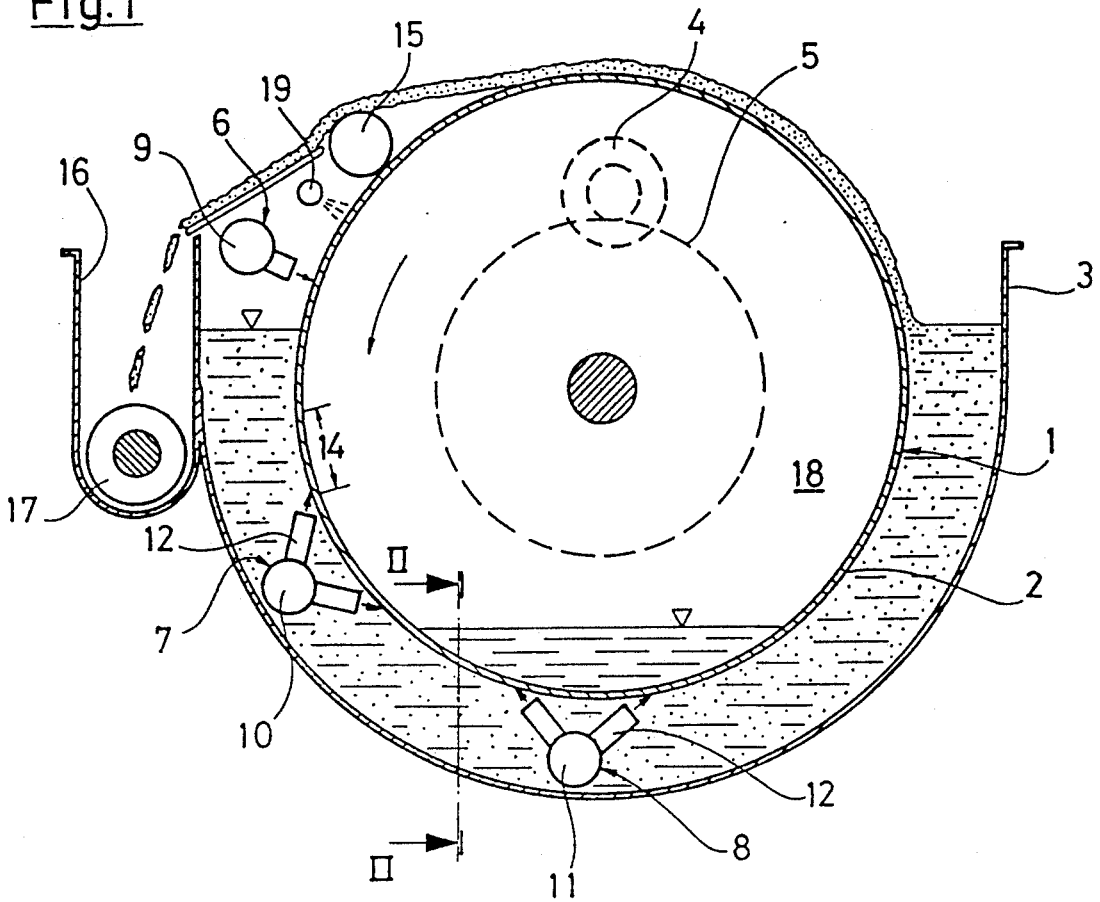

The drum filter shown in FIG. 1 comprises a hollow filter body in the form of a horizontal drum 1 with a circular circumferential wall 2 of filter material. The drum 1 is rotatably journalled in a container 3. During operation the drum 1 is partly immersed in a pool of a created coarse fraction of a fibre suspension in the container 3. A drive motor 4 is in drivable engagement with the drum 1 via a gear wheel 5 for rotating the drum 1 around its central axis. (The direction of rotation of the drum 1 is indicated by an arrow in FIG. 1).

Figure 2:
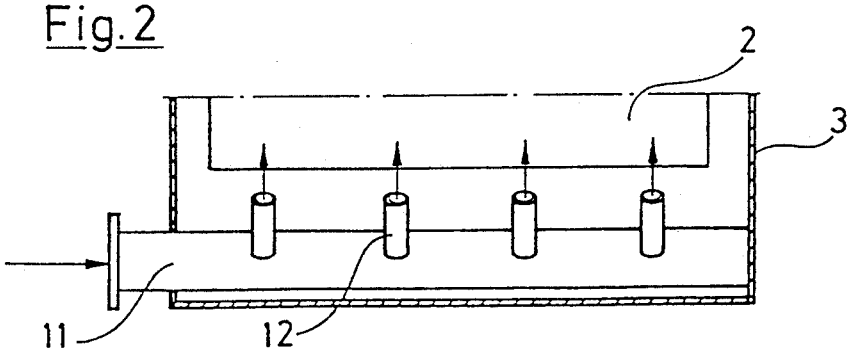
FIG. 2 shows a section along the line II—II of FIG. 1.
Figure 3:
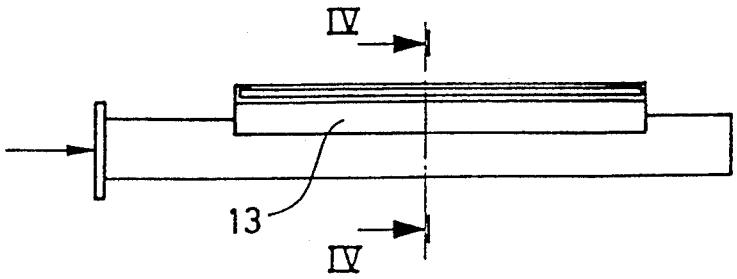
FIG. 3 shows a modification of the embodiment shown in FIG. 2.
Figure 4:
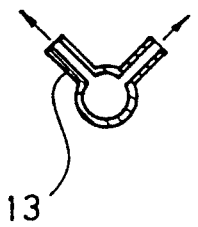
FIG. 4 shows a section along the line IV—IV of FIG. 3.

The fibre suspension to be separated is supplied to the drum filter by means of a spray member 6, which is above said pool of coarse fraction in the container 3 descending the side of the circumferential wall 2, and two spray members 7 and 8, which are situated in said pool of coarse fraction. The spray members 6–8 include supply pipes 9–11, respectively, for fibre suspension to be separated, which extend axially along the circumferential wall 2 of the drum 1 (FIG. 2). Each supply pipe 9–11 is provided with a plurality of spray nozzles 12 (here eight), which are directed against the circumferential wall 2. As an alternative each supply pipe 9–11 may be provided with only two spray nozzles 13, each spray nozzle 13 having an elongated outlet opening (FIG. 3 and 4). The spray member 7 is adapted to spray fibre suspension on a zone 14 at the descending side of the circumferential wall 2 at a small distance from the surface of the coarse fraction.

Above the spray member 6 there is a device 15 for the removal of built up layers of fibres from the circumferential wall 2. The removal device 15 is adapted to transfer removed fibre layers to a trough 16, which is provided with a conveyor screw 17.

The interior of the drum 1 forms a filtrate chamber 18, which is connected to a device not shown for discharging fine fraction formed during the operation from the drum filter.

Between the removal device 15 and the spray member 6 there is a spray member 19 for cleaning the filter material of the circumferential wall 2 by means of cleansing liquid, for instance water.

The drum filter according to FIG. 1 is operated in the following way:

All the fibre suspension to be separated, for instance a fibre suspension produced from waste paper pulp and containing about 0.5% fibres, undesired small particles consisting substantially of printing ink, and water, is sprayed in the form of liquid jets by means of the spray members 6-8 onto the circumferential wall 2 of filter material during rotation of the drum 1 by the drive motor 4, the fibre suspension being separated into a fine fraction, which passes through the circumferential wall 2 into the filtrate chamber 8 and which substantially contains undesired particles and water, and a coarse fraction of the fibre suspension, which is received in the container 3 and which substantially contains fibres and water. By the hydrostatic pressure in the pool of coarse fraction formed in the container 3 water is forced from said pool through the circumferential wall 2 of filter material into the filtrate chamber 18, whereby fibres are deposited on the circumferential wall creating a layer of fibre pulp on it. This layer is rapidly created on the circumferential wall 2 when the wall goes down into the pool of coarse fraction and will be thicker and thicker during the displacement of the circumferential wall 2 through said pool. The layer of fibre pulp on the circumferential wall 2 along the zone 14 is however not yet very thick and can easily be removed by the jets of suspension from the spray member 7. When the circumferential wall 2 has passed the jets of suspension from the spray member 7 there is once more created on the circumferential, wall 2 a layer of fibre pulp, which in turn is easily removed by the jets of suspension from the spray member 8. Thus, the descending side of the circumferential wall 2 in the pool of coarse fraction is substantially free from a thick, tight layer of fibre pulp, with the result that the pool of coarse fraction is efficiently dewatered through the circumferential wall 2 at the sinking side of the latter.

On the rising side of the circumferential wall 2 a thick layer of fibre pulp is created, which follows the circumferential wall out of the pool of coarse fraction to the removal device 15. This removes the fibre pulp from the circumferential wall 2 and transfers the fibre pulp to the trough 16, whereafter the conveyor screw 17 discharges the fibre pulp from the drum filter. The part of the circumferential wall 2 which has just been freed from fibre pulp by the removal device 15, is cleansed by means of the spray member 1, whereafter the operation described above is repeated.

The drum filter according to FIG. 1 can be operated so that the obtained fibre pulp will have a consistency of about 8–12%. However, if a lower consistency of the fibre pulp of about 3–4% would be acceptable the removal device 15 can be replaced by an overflow in the container 3 for the coarse fraction of fibre suspension at the rising side of the circumferential wall 2. In this case further spray members for fibre suspension to be separated may be arranged along the drum 2 above the pool of coarse fraction, which would increase the capacity of the drum filter.

Figure 5:
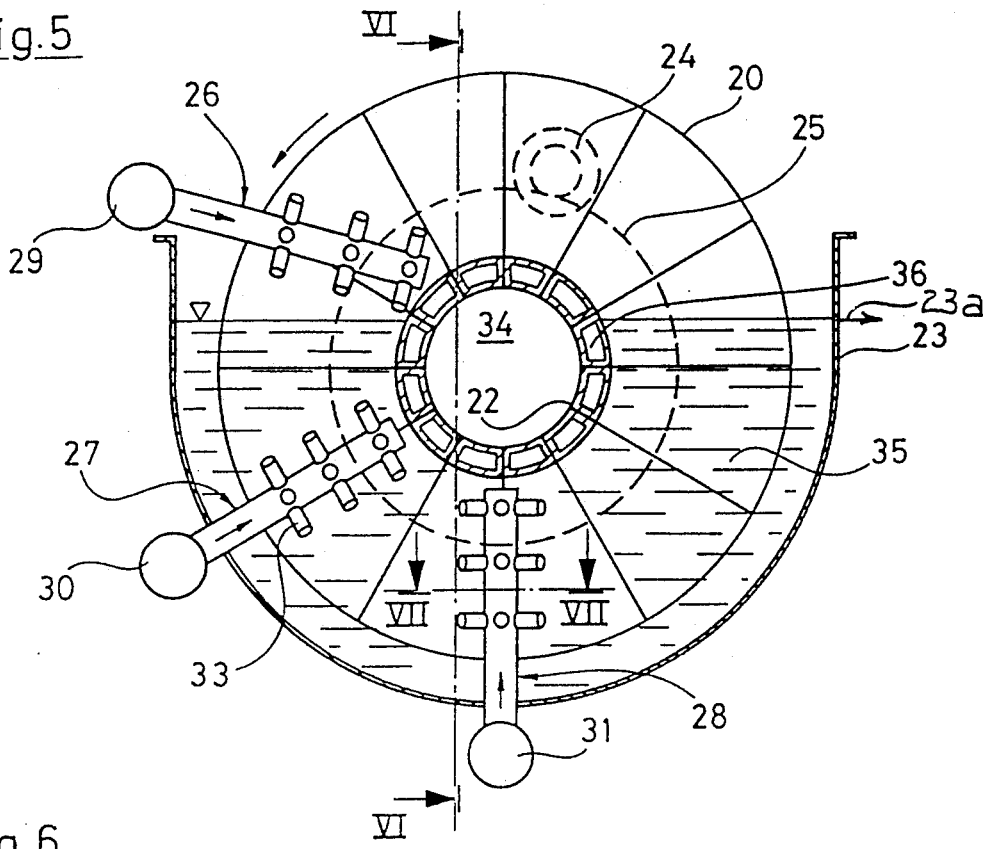
FIG. 5 schematically shows a disc filter according to another embodiment of the device according to the invention.

The disc filter shown in FIG. 5 comprises a plurality of vertical annular, hollow discs 20 with walls 21 of filter material. The discs 20 are, via a hollow shaft 22, rotatably journalled coaxially with each other in a container 23. During operation the discs are partly immersed in a pool of coarse fraction formed in the container 23. A drive motor 24 is in drivable engagement with the shaft 22 via a gear wheel 25 for rotating the discs 20 about the shaft 22. (The rotational direction of the discs 22 is indicated by an arrow in FIG. 5).

Figure 6:
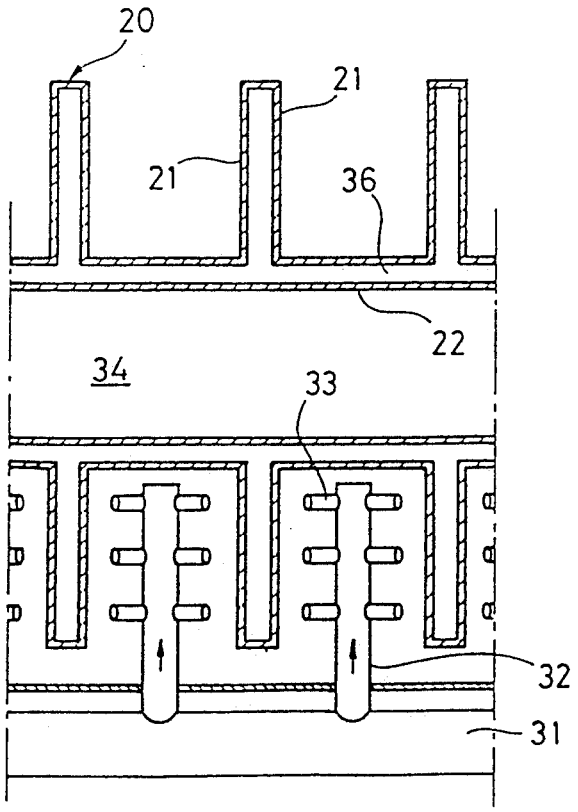
FIG. 6 shows a part of a section along the line VI—VI of FIG. 5.
Figure 7:
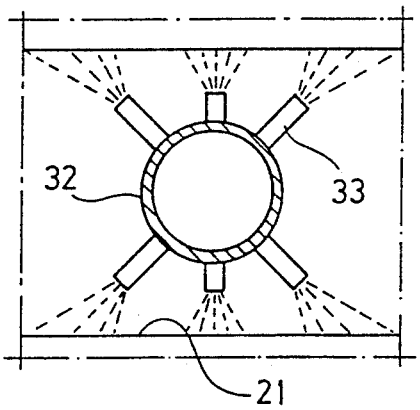
FIG. 7 shows a sectional view along the line VII—VII of FIG. 5.

Fibre suspension to be separated is supplied to the disc filter by means of a spray member 26, which is situated above said pool of coarse fraction in the container 23 at the descending sides of the discs 22 and two spray members 27 and 28, which are situated in said pool of coarse fraction. The spray members 26–28 include supply pipes 29–31, respectively, for fibre suspension to be separated, which extend axially along the discs 2. Each supply pipe 29–31 is connected to a number of distribution pipes 32 which extend radially along the side walls 21 of the discs 20. Each distribution pipe 32 is provided with spray nozzles 33 for spraying fibre suspension onto an adjacent side wall 21 (FIG. 6). Each of the distribution pipes 32 which extends between two adjacent discs 20 has nine spray nozzles 33 for spraying the side wall 21 of one of the discs and nine spray nozzles 33 for spraying the adjacent side wall 21 of the other disc 20 (FIG. 7).

The interior of the discs 20 communicates with the interior of the shaft 22 which forms a filtrate chamber 34 connected to a device, not shown, for discharging created fine fraction from the disc filter.

By means of drop legs connected to the interior of the discs 20 the disc filter, can be operated so that the fibre pulp obtained will have a fibre consistency of about 8-12 %, whereby the concentrated fibre pulp may be removed from the side walls of the discs above said pool of coarse fraction by means of a removal device well known in the art of filtration and not shown in the drawing. In this case each disc 20 is divided, for instance, into twelve chambers 35, which are connected in sequence to each drop leg via axial pipes 36 during rotation of the disc. As an alternative the disc filter can be operated without drop legs, so that the fibre pulp obtained will have a fibre consistency of only about 3–4%. In this case, the fibre pulp can be removed directly from the container 23 via an overflow.

The operation of the disc filter is analogous to that of the drum filter and, consequently, should be clear from the description above of the operation of the drum filter.

Figure 8:
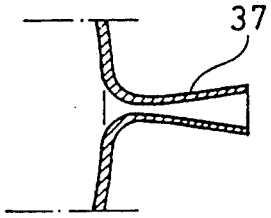
FIG. 8 shows a modification of a spray nozzle.

In case spray nozzles 12, 33 with passages of relatively small cross-sectional areas must be used, a risk of clogging the spray nozzles 12, 33 with fibre pulp might arise, for instance at sudden pressure drops in the passages of the spray nozzles 12, 33 during operation. In this case each spray nozzle 12, 33 may advantageously be formed with an increasing cross-sectional area towards the opening (FIG. 8), whereby a clogging or plug of fibre pulp can easier be forced through the nozzle when the operational pressure is restored after a pressure drop.

I claim:

1. A method of separating a fibre suspension by means of a filter device having a hollow filter body with a wall of filter material, and a container in which the filter body is arranged, said method comprising spraying fibre suspension against the wall of filter material to force a fine fraction of the fibre suspension through the wall of filter material into the hollow filter body and leave a pool of coarse fraction of the fibre suspension in the container outside the hollow filter body, positioning the hollow filter body in said pool of coarse fraction, dewatering said coarse fraction through said wall of filter material, discharging the dewatered coarse fraction from the container, displacing the wall of filter material alternately up and down through the surface of said pool of coarse fraction, and spraying fibre suspension against the wall of filter material as the latter is displaced above said pool of coarse fraction.

2. The method of claim 1, wherein fibre suspension is also sprayed against the wall of filter material as the latter is displaced in said pool of coarse fraction.

3. The method of claim 2, wherein fibre suspension is sprayed against the wall of filter material as the latter is displaced downwardly in said pool of coarse fraction.

4. A separator device for separating a fibre suspension, comprising a hollow filter body having a wall of filter material, a container in which the filter body is situated, supply means for furnishing fibre suspension to be separated to the separator device, spray means arranged to spray fibre suspension onto said wall of filter material, means for providing relative displacement between said spray means and said wall of filter material, said supply means being arranged to supply said spray means with the entire fibre suspension to be separated, said spray mans being positioned relative to said hollow filter body to force a fine fraction of the fibre suspension through said wall of filter material into said hollow filter body and leave a pool of a coarse fraction of the fibre suspension in said container outside said hollow filter body, said hollow filter body adapted to being positioned in said pool of coarse fraction to dewater said coarse fraction through said wall of filter material, and means for discharging said dewatered coarse fraction from said container wherein said displacement means being arranged to displace said wall of filter material alternately up and down whereby the filter material is displaced through the surface of said pool of coarse fraction, and said spray mans being arranged to spray fibre suspension onto a part of said wall of filter material which is displaced downwardly by said displacement means.

5. A separator device according to claim 4, wherein said hollow filter body comprises a drum having a circumferential wall of filter material, and said displacement means is arranged to rotate said drum about a horizontal axis coaxial with said drum, for rotational displacement of said circumferential wall of filter material up and down, whereby the filter material is displaced through the surface of said pool of coarse fraction.

6. A separator device according to claim 5, wherein said spray means comprises a supply pipe for fibre suspension extending outside of said drum axially along said circumferential wall of filter material, and at least one spray nozzle connected to said supply pipe for spraying fibre suspension onto said circumferential wall of filter material.

7. A separator device according to claim 4, wherein said hollow filter body comprises at least one vertical annular disc having two side walls of filter material spaced from each other, and said displacement means is arranged to rotate said disc about a horizontal axis which is coaxial with said disc, for rotational displacement of said side walls of filter material up and down, whereby the filter material is displaced through the surface of said pool of coarse fraction.

8. A separator device according to claim 7, wherein said spray means comprises a supply pipe for fibre suspension, distribution pipes connected to said supply pipe and extending along said side walls of filter material, and at least one spray nozzle connected to each distribution pipe for spraying fibre suspension onto an adjacent side wall of filter material.

9. A separator device according to claim 8, wherein said hollow filter body comprises a plurality of discs, each of the distribution pipes extending between two adjacent discs and being provided with at least one spray nozzle for spraying the side wall of one of said adjacent discs and at least one spray nozzle for spraying the adjacent side wall of the other disc.

* * * * *